United States Patent [19]

Warner et al.

[11] 4,058,815

[45] Nov. 15, 1977

[54] METERING SYSTEM FOR A COPIER/DUPLICATOR MACHINE

[75] Inventors: George M. Warner, Cheltenham; Leif E. Andberg, London, both of England

[73] Assignee: Rank Xerox Ltd., London, England

[21] Appl. No.: 511,844

[22] Filed: Sept. 30, 1974

[30] Foreign Application Priority Data

Jan. 25, 1974 United Kingdom ..... 03473/74

[51] Int. Cl.[2] ..... G03G 15/00

[52] U.S. Cl. ..... 355/14; 355/15; 235/92 SB

[58] Field of Search ..... 355/14, 15; 235/92 SB, 235/92 DE, 103 R, 132, 177

[56] References Cited

U.S. PATENT DOCUMENTS

| | | | |
|---|---|---|---|
| 2,996,249 | 8/1961 | Wang | 235/177 |
| 3,273,122 | 9/1966 | Chandler | 235/177 |
| 3,358,570 | 12/1967 | Morrill et al. | 95/1.7 |
| 3,576,431 | 4/1971 | Zaccard et al. | 235/92 |
| 3,655,281 | 4/1972 | Warren | 355/3 |
| 3,710,936 | 1/1973 | Mizunuma | 235/92SB |
| 3,813,157 | 5/1974 | Fantozzi | 355/14 |
| 3,856,125 | 12/1974 | Post | 192/127 |
| 3,886,329 | 5/1975 | Kamiyama | 355/14 |
| 3,971,919 | 7/1976 | Fantozzi | 235/92 PE |
| 3,974,363 | 8/1976 | Malinich | 355/14 |
| 3,989,930 | 11/1976 | Sohm | 355/14 |

OTHER PUBLICATIONS

Eastman Kodak Research Disclosure, Oct. 1974, pp. 57–58.

*Primary Examiner*—Russell E. Adams
*Attorney, Agent, or Firm*—Earl T. Reichert

[57] ABSTRACT

An improved metering system is provided for an electrostatic reproduction machine, the latter being capable of operating in either an automatic document handling mode or a manual mode. The system counts the number of originals per job up to a predetermined first number, the total number of originals fed into the machine, and the total number of prints made. What is counted depends on whether the machine is in the automatic mode or in the manual mode and how many prints the machine is programmed to produce.

6 Claims, 1 Drawing Figure

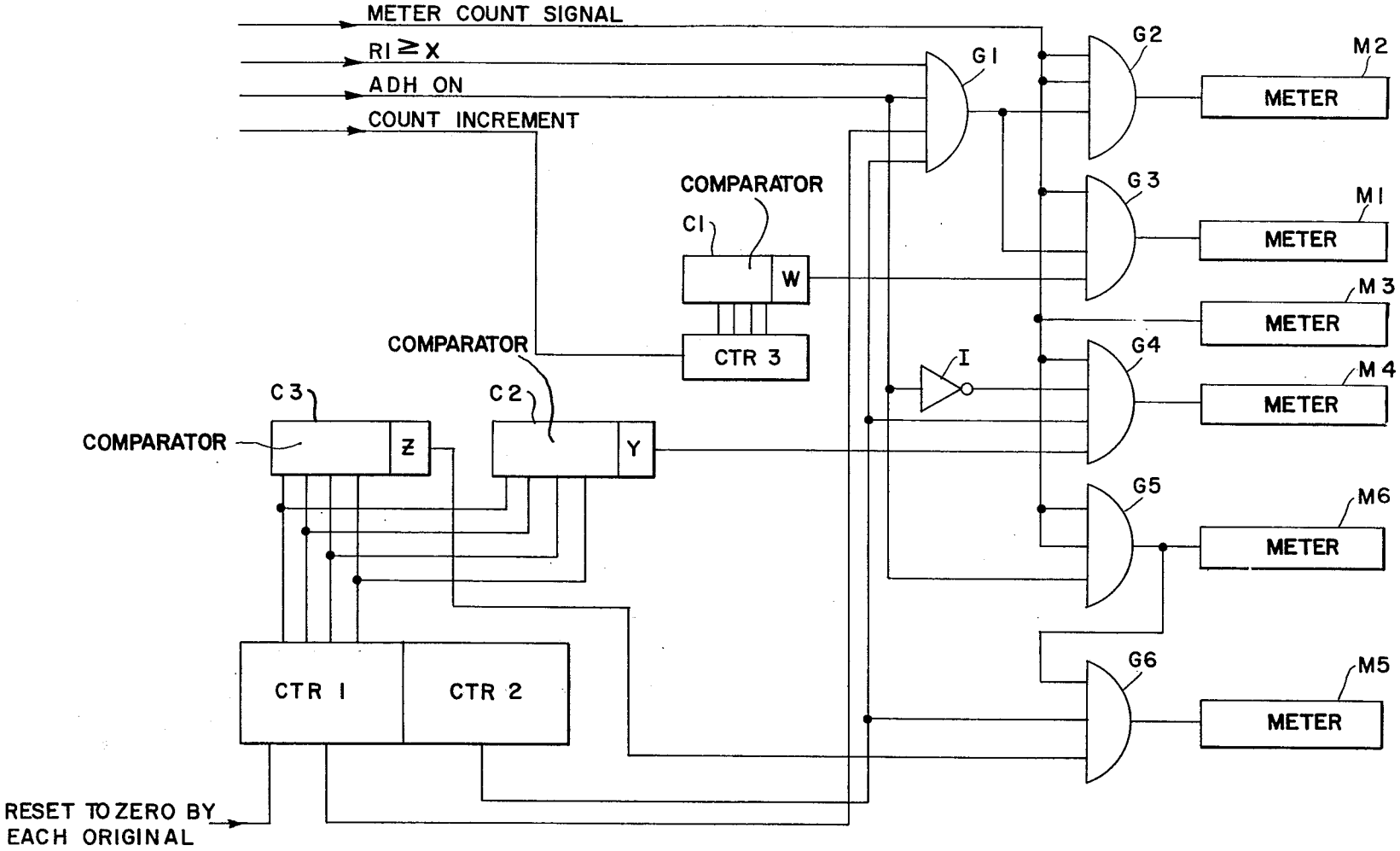
M2
METER
M1
METER
M3
METER
M4
METER
M6
METER
M5
METER
G2
G3
G4
G5
G6
G1
I
COMPARATOR
C1
W
CTR 3
Y
C2
COMPARATOR
Z
C3
COMPARATOR
CTR 2
CTR 1
METER COUNT SIGNAL
R1 ≧ X
ADH ON
COUNT INCREMENT
RESET TO ZERO BY EACH ORIGINAL

METERING SYSTEM FOR A COPIER/DUPLICATOR MACHINE

BACKGROUND OF THE INVENTION

This invention relates to a copying/duplicating machine (a reproduction machine for making copies or prints of an original), and in particular to a metering arrangement in such a machine for counting the number of prints made by the machine so that a charge can be made for the prints made.

In known reproduction machines such as xerographic machine, a variety of counting arrangements have been employed. In a typical known arrangement, prints made up to a certain number from each original have been counted on a first counter, whereas all prints made from an original in excess of that number have been counted on another counter. It is then possible to charge all copies made from a single original in excess of the chosen number at a lower rate than the first few copies made from that original. This method of counting and billing, therefore, favors a duplicting mode of operation, i.e., one in which many copies are made from each original. In the offset litho method of duplicating an original, it is necessary to first prepare a master from which it is possible to produce as many prints as are required. In this method, therefore, a duplicating mode of operation is favored since the cost of producing each master is high compared with the cost of making an individual print from the master.

The present invention has particular application in the field of xerographic reproduction, and is especially useful in a machine of this kind which has both a manual feed arrangement for placing originals to be duplicated in the machine and an automatic document handling arrangement in which a stack of originals to be duplicated are automatically fed in sequence to the machine. In each case the desired number of prints are automatically made by the machine. In the automatic mode, it is usual for the prints produced by the machine to be sorted automatically into a series of collection bins, so that at the end of each complete copying operation, the required number of prints of the whole stack of originals is produced, one complete set of prints of each original in the stack being found in each of the appropriate number of bins.

The latest concept for electrostatic reproduction machines utilizes high speed flash exposure of a document, and a moving photoconductive material in the form of an endless belt which is continuously charged. Additionally, such machines are provided with a developing system which supplies toner particles in relatively large quantities for solid area coverage, such as a magnetic brush developing apparatus. Thus, after the belt passes the magnetic brush assembly for example, a xerographic powder image is formed on the belt which corresponds to the electrostatic latent image. This powder image is then transferred to a support surface (e.g., a sheet of paper) to which it is fused by a fusing assembly whereby the powder image is caused to adhere to the support surface permanently.

Further description of such a high speed reproduction machine is to be found in copending U. K. patent application No. 56230/73. A machine of this kind incorporating one form of a metering arrangement for billing purposes is described in copending U.S. Pat. application Ser. No. 526,652, filed 25 November 1974.

In connection with counting prints made in the kind of duplicating machine just described, it is useful to use certain terms to describe the operation of the counting methods employed. The following terms, where used throughout this specification and claims, will be given the meanings which follow. A "print" is any copy made by the machine in whatever mode of operation. An "original" is any document fed into or placed in the machine, manually or automatically, for copying thereof. A "job" is a complete reproduction operation, in the automatic mode, from feeding the first original into the machine to delivery from the machine of the last print from the last original.

It will be appreciated that in machines of the kind just described, there is available a considerable range of possible modes of operation, from jobs in which a single print is made from a single original in a manual operation mode to jobs in which hundreds of prints are made from each one of a stack containing many originals. In these circumstances it is desirable to be able to have available a counting arrangement which will allow a user of the machine to be billed in the most economical way according to his predominant mode of use and having regard to the incidence of wear, breakdowns, service calls and the cost of consumable materials.

It is, therefore, an object of the present invention to provide a reproduction machine including a metering arrangement for counting as desired, numbers of jobs, originals and prints in such a fashion as to allow considerable flexibility in the way the machine user is billed for the use of the machine.

SUMMARY OF THE INVENTION

According to the present invention there is provided a reproduction machine capable of operating in an automatic document handling mode in which a required number of prints are automatically made from each one of a stack of originals, the machine including a metering arrangement for providing an indication, on a plurality of counters, of the number of originals per job up to a predetermined first number, of the total number of originals fed into the machine, and of the number of prints made, the terms original and print being as hereinbefore defined.

A metering arrangement for a reproduction machine in accordance with the invention will now be described, by way of example, with reference to the accompanying drawing, which is a schematic block diagram showing part of a circuit for counting jobs, originals and prints.

DETAILED DESCRIPTION OF THE INVENTION

Referring to the drawing, a set of six meters labelled M1 to M6 are provided for recording counts of jobs, originals and prints, as will become apparent. Meter M2 is for counting the total number of originals which are fed into the machine when it is in its automatic document handling (ADH) mode, provided that the machine has been programmed to have a "run length", that is to say the number of prints per original which it is desired to print, greater than a predetermined number X. The number X, which is called a "breakpoint", and which might typically lie between 2 and 25, is chosen to take into account the fact that it will often be desirable to run proof prints of a stack of originals which are to be duplicated. In accordance with the usual pricing schemes, as mentioned above, the unit cost of making only a few prints might be rather high compared with the unit cost of a long run of prints. If the breakpoint is at X=10, then it will be possible to run up to nine proof prints of each of a set of originals without incurring any count for the originals (and therefore without incurring any charge on this particular meter). If 10 or more prints per original are to be made, however, the total number of originals fed are counted by this meter M2.

The operation of meter M2 will now be described. The output of a gate G1 is gated with a meter count signal into gate G2. A meter count signal is provided each time a print is made. The presence of signals at both inputs of gate G2 causes a count to be added to the count recorded on meter M2. There are four inputs to gate G1, this gate only prividing an output signal if all four inputs have signals. The uppermost input to gate G1 shown in the drawings has a signal on it if the run length is greater than or equal to X. Such a signal may be derived from a comparator (not shown) which compares X with the number of prints selected on the print quantity selector of the machine. The second input to gate G1 is provided with a signal whenever the machine is in the ADH mode. The third and fourth inputs to gate G1 are provided respectively with signals when the outputs of counters CTR1 and CTR2 are zero. Counters CTR1 and CTR2 are both reset to zero each time an original is fed into the machine.

The number X can be programmed into the machine by means of a pre-wired component, such as a print circuit card, which can be changed for another such component having a different pre-set X, the component being a plug-in or easily soldered component.

Meter M1, like meter M2, is operative only when the machine is in the ADH mode, and when the run length is greater than X. Meter M1 can operate in either of two modes; in a first mode it counts the number of jobs carried out by the machine, whereas in the second mode it counts the number of originals per job, for each job, up to a breakpoint W. In fact, in the first mode, meter M1 simply counts the first original in each job, with W set to W=1, thereby effectively counting the number of jobs.

Meter M1 is actuated by a gate G3, which provides an output signal only when there is a signal on each of its three inputs. The uppermost input, as shown in the drawing, is the meter count signal. The second input is taken directly from the output of gate G1, which, as explained above, provides an output signal when the machine is in the ADH mode and the run length is greater than X. The third input to gate G3 is derived from a comparator C1 which compares the count of originals with the number W, to provide an output when the count of originals is less than or equal to W. The number W can be programmed into the machine in the same way as the number X, i.e., by a pre-wired component such as a printed circuit card.

Meter M3 simply counts the total number of prints made, regardless of the mode in which the machine is operating. The meter is actuated by the meter count signal directly, this signal providing one count for each print made.

Meter M4 operates only when the machine is in the manual mode, and counts the number of prints per original up to a breakpoint Y. Thus, if the selected run length (number of prints per original) is less than or equal to Y, meter M4 counts all prints, whereas if the run length is greater than Y, the meter counts up to and including Y, and then stops counting. Meter M4 is actuated by an output signal from a gate G4, such a signal being provided only when there are signals on all four inputs to the gate G4. The uppermost input to gate G4, as seen in the drawings, is the meter count signal. The signal input has a signal on it when the signal denoting that the ADH is on is absent (i.e., the ADH is off so the machine is in the manual mode). This is done by connecting the second input of gate G4 to the input of gate G1 by way of an inverter I. The third input of gate G4 is provided with a signal when the output from counter CTR2 is zero. The output of counter CTR2 stays at zero until it receives a first count signal from counter CTR1 when counter CTR1 is at its maximum count (e.g., 25). The fourth input to gate G4 is the output from a comparator C2 which compares the number of prints made from a given original with the number Y, which typically lies between 1 and 25. If the number of prints is less than or equal to Y, the comparator provides an output signal.

Meter M6 counts the total number of prints made by the machine in the ADH mode. The meter is actuated by the output of a gate G5, the inputs of which are connected to the meter count signal, and the "ADH on" line.

Meter M5 operates only when the machine is in the ADH mode, and counts the number of prints per original up to a breakpoint Z. Thus, if the selected run length (number of prints per original) is less than or equal to Z, meter M5 counts all prints, whereas if the run length is greater than Z, the meter counts up to and including Z, and then stops counting. Meter M5 is actuated by an outpout signal from a gate G6, such a signal being provided only when there are signals on all three inputs of the gate. The uppermost input is derived from the output of gate G5, and the second input has a signal on it when the output of counter CTR2 is zero. The third input is the output of the comparator C3 which compares the number of prints made from a given original with the number Z, which typically lies between 1 and 25. If the number of prints is less than or equal to Z, the comparator provides an output signal.

The numbers Y and Z can be programmed into their respective comparators, C2 and C3, in the same way as the numbers W and X, i.e., by pre-wired components such as printed circuit cards.

A summary of what the meters count is given in the following table:

| Meter No. | Meter Activated When Using: | What Meter Cumulatively Counts: |
|---|---|---|
| M1 | ADH | When run length is X or more (a) jobs (when W=1). (b) up to W originals per job (when W>1). |
| M2 | ADH | When run length is X or more, total number of originals. |
| M3 | ADH and Manual | Total number of prints, both in ADH and Manual. |
| M4 | Manual | Prints per original up to Y. |
| M5 | ADH | Prints per original up to Z. |
| M6 | ADH | Total number of prints in ADH. |

The metering arrangement described can be used in a variety of billing schemes without the need to re-design any of the circuitry. The only changes needed in the different schemes are changes in the value of W, X, Y, and Z. Some examples of billing schemes which make use of the counts recorded on meters M1 to M6 will now be described.

EXAMPLE 1

In this example, charges are made for jobs, originals and prints, as follows:

A first charge is made for each job done when the machine is in the ADH mode, and for this purpose, W is set to W = 1. If each job is charged at a pence, it is only necessary to multiply the count on meter M1 by *a* to arrive at the first charge.

A second charge is made for each original in every job done in the ADH mode in which the run length (number of prints run original) is greater than, or equal to X. No charge of this kind is made if the run length is less than X, thereby allowing short runs of proof prints to be made without a charge being made for each original. If each original charged is charged at *b* pence, then the second charge is found by multiplying the count on meter M2 by *b*.

A third charge is made for each print made from an original in the manual mode up to a breakpoint Y. If each such print is charged at *c* pence, the third charge is found by multiplying the count on meter M4 by *c*.

A fourth charge is made for each print made from an original, in the manual mode, in excess of Y, as well as for every print made in the ADH mode. If each such print is charged at *d* pence, the fourth charge is found by subtracting the count on meter M4 from the count on meter M3, and multiplying the result by *d*.

EXAMPLE 2

In this example, the first three charges are made in exactly the same way as in Example 1. A new fourth charge, and additional fifth and sixth charges, are made as follows;

A fourth charge is made for each print made from an original, in the manual mode, in excess of Y. If each such print is charged at *d* pence the fourth charge is found by subtracting from the count on meter M3, the sum of the counts on meter M6 and meter M4, and multiplying the result by *d*.

A fifth charge is made for each print made from an original in the ADH mode up to a breakpoint Z. If each such print is charged at *e* pence, the fifth charge is found by multiplying the count on meter M5 by *e*.

A sixth charge is made for each print made from an original, in the ADH mode, in excess of *z*. If each such print is charged at *f* pence, the sixth charge is found by subtracting the count on meter M5 from meter M6 and multiplying the result by *f*.

EXAMPLE 3

In this example, a charge is made in accordance with the number of originals per job, meter M1 in this case counting the number of originals per job, and not jobs.

A first charge is made for all originals per job up to *w*. If the charge for each original up to W is *g* pence, then the first charge is found by multiplying the count on meter M1 by *g*.

A second charge is made for all originals per job in excess of W. If the charge for all such further originals per job is *h* pence per original, the second charge is found by subtracting the count on meter M1 from the count on meter M2 and multiplying the result by *h*.

The third and fourth charges are calculated in the same way as the third and fourth charges of Example 1.

EXAMPLE 4

In this example, the first two charges are exactly the same as in Example 3. Third, fourth, fifth and sixth charges are made in exactly the same way as in Example 2.

EXAMPLE 5

In this example, the machine is programmed to provide the kind of billing already used on many xerographic copying machines.

A first charge is made for all prints made, in whatever mode, up to a breakpoint M. For this purpose Y and Z are both set equal to M, and if the charge per print for all prints up to M is *j* pence, the first charge is found by adding the counts from meters M4 and M5 together, and multiplying the result by *j*.

A second charge is made for all prints made, in whatever mode, in excess of M. If each such print is charged at *k* pence, the second charge is found by subtracting, from the count of meter M3, the sum of the counts on meters M4 and M5, and multiplying the result by *k*.

What is claimed is:

1. An improved metering system for a reproduction machine capable of operating either in an automatic document handling mode in which during a job a required number of prints are automatically made from each one of a stack of originals, or a manual mode, wherein the improved metering system comprises;
   a. means for counting the number of originals per job up to a predetermined first number;
   b. means for counting the total number of originals fed into the machine; and
   c. means for counting the total number of prints made.

2. An improved metering system according to claim 1, and further including means for actuating the counting means set forth in paragraph (*a*) of claim 1 to count only when the machine is in the automatic mode and is programmed to print more than predetermined second number of prints per original.

3. An improved metering system according to claim 2, and further including means for actuating the counting means set forth in paragraph (*b*) of claim 1 to count only when the machine is in the automatic mode and is programmed to print more than the predetermined second number of prints per original.

4. An improved metering system according to claim 1, and further including means for counting the number of prints made up to a third predetermined number of prints per original only when the machine is in the manual mode.

5. An improved metering system according to claim 1, and further including means for counting the number of prints made up to a fourth predetermined number of prints per original only when the machine is in the manual mode.

6. An improved metering system according to claim 1, and further including means for actuating the counting means set forth in paragraph (*c*) of claim 1 to count only when the machine is in the automatic mode.

* * * * *